United States Patent [19]

Margulies et al.

[11] 4,294,361

[45] Oct. 13, 1981

[54] PUSH AND PEEL BLISTER STRIP PACKAGES

[75] Inventors: Herman Margulies, South Orange; Richard H. Kaufman, Ridgewood, both of N.J.

[73] Assignee: Sterling Drug, Inc., New York, N.Y.

[21] Appl. No.: 106,850

[22] Filed: Dec. 26, 1979

Related U.S. Application Data

[63] Continuation-in-part of Ser. No. 28,399, Apr. 9, 1979, abandoned.

[51] Int. Cl.[3] ..... B65D 83/04; B65D 85/56; B65D 75/36; B65D 75/58

[52] U.S. Cl. ..... 206/532; 206/634; 206/820

[58] Field of Search ..... 206/532, 564, 531, 820, 206/634, 484, 632, 631, 633

[56] References Cited

U.S. PATENT DOCUMENTS

| | | | |
|---|---|---|---|
| 3,419,137 | 12/1968 | Walck | 206/632 |
| 3,635,376 | 1/1972 | Hellstrom | 206/634 |
| 3,872,970 | 3/1975 | Edison | 206/532 |
| 3,921,805 | 11/1975 | Compere | 206/532 |

*Primary Examiner*—William T. Dixson, Jr.
*Attorney, Agent, or Firm*—Charles R. Fay

[57] ABSTRACT

A blister strip package comprising two coextensive sheets of heat sealable material provided with a first row of individual cavities for containing a product to be dispensed in one of said sheets, said first row of cavities being laterally aligned with a corresponding, opposing row of an equal number of second cavities in the same sheet, the cavity bearing sheet being heat sealed to the other sheet except in the areas defined by the cavities and, in one embodiment of the invention, being also heat sealed in areas spaced from the second cavities and adjacent to weakened lines for disruption of the covering sheet, whereby the second cavities can be pushed inwards and thus inverted to bear upon the covering sheet in order to thereby disrupt it at score lines or slits and to form a pull tab which can be grasped and pulled towards the aligned, respective pair of second and first cavities thereby peeling the covering sheet from the cavity bearing sheet and forming a direct access along predetermined lines to a selected first cavity.

17 Claims, 6 Drawing Figures

PUSH AND PEEL BLISTER STRIP PACKAGES

This application is a continuation-in-part of Application Ser. No. 28,399, filed Apr. 9, 1979, now abandoned.

BACKGROUND OF THE INVENTION

Containers or packages for medicaments are desirably easily openable by adults but not by children. There have been many attempts to provide such packages in blister form, but in some cases they are difficult to open even by an adult. It is the general purpose of the present invention to provide a package which is easily openable by one having knowledge of the opening procedure but which is difficult to open by a small child unfamiliar with the procedure.

PRIOR ART

British Pat. No. 577,151, published May 7, 1946, describes blister packages having dummy pockets which can be "easily broken thereby enabling a finger nail to be inserted between the two interadhered webs" for pulling apart a covering layer from a second blister-containing layer for easy access to the blisters in the latter. However this patent does not suggest specific unsealed areas for the purposes described herein.

SUMMARY OF THE INVENTION

The blister packages contempated by the present invention are particularly useful in the packaging of medicaments such as capsules, tablets and the like. Since the packages of the invention require certain opening manipulations which would thwart opening by small children, they are particularly useful in the field of child resistant strip packaging. The packages of the invention comprise two heat-sealed sheets, one of which is shaped, for example by thermoforming, so as to provide a first cavity or row of cavities intended to contain a product to be dispensed, for example capsules, tablets, etc., the other of which serves as a covering sheet to cover the former. Spaced from each first cavity or row of cavities in the cavity bearing sheet is a second cavity or row of second cavities equal in number to, and directly opposed to, the first cavity or row of cavities. The second cavities can be pushed inwards and inverted to disrupt the covering sheet from the cavity bearing sheet thus providing a pull tab which may be grasped and pulled towards the aligned pair of second and first cavities in order to peel off the covering sheet and provide access to the product dispensing cavities along predetermined weakened lines.

The package is also provided with perforations between individual pairs of first and second cavities and extending through both sheets which permit tearing off one product dispensing unit at a time.

PREFERRED EMBODIMENTS OF THE INVENTION

Figure 1:
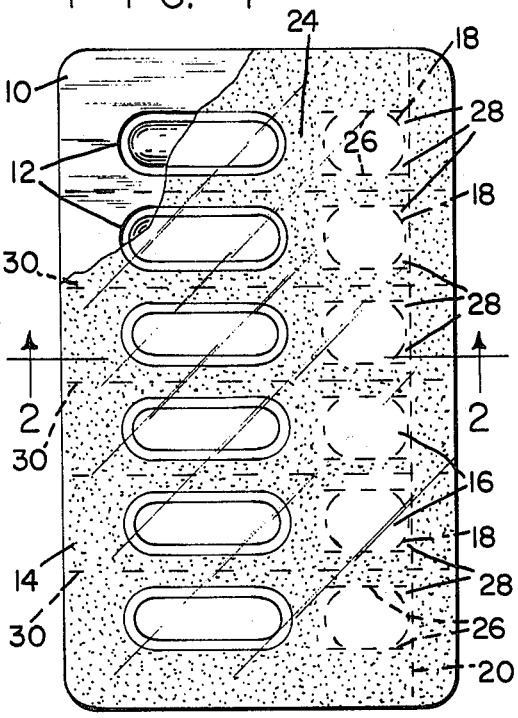
FIG. 1 is a view illustrating the invention.

A sheet of heat sealable material, for example plastic, is indicated at 10 which underlies a second sheet 14, which is heat sealed to the latter as indicated by the shading in FIG. 1. The underlying sheet contains a first cavity or row of cavities 12, produced for example by thermoforming and intended to contain a product for dispensing, for example tablets, capsules and the like. The underlying or cavity bearing sheet is overlayed by a covering sheet 14 which keeps the contents of the first cavities in pristine condition. It will be seen that the two sheets are heat sealed completely about each cavity. The underlying or cavity bearing sheet desirably should be relatively stiff in contrast to the covering sheet which desirably should be somewhat pliable. The desired degrees of stiffness in the two sheets can thus be achieved by use of thicker material in the cavity bearing sheet than that used in the covering sheet.

Figure 2:
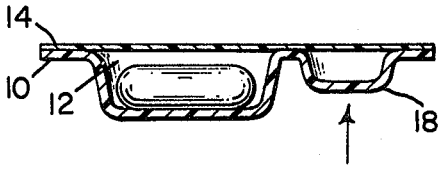
FIG. 2 is a section on line 2—2 of FIG. 1.
Figure 3:
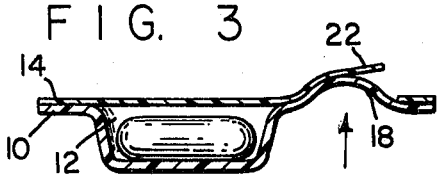
FIG. 3 is a view similar to FIG. 2, illustrating the inverted second cavity and the pull tab which is produced by the inversion.

Laterally aligned with each first cavity in the cavity bearing sheet and spaced therefrom is a corresponding second cavity or row of cavities 18 which, like the first cavities, are covered by the covering sheet 14, the covered area of the second cavities being represented by the area 16 in FIG. 1. In the manipulation of this embodiment to provide access to any individual first cavity, it is merely necessary to depress a second cavity 18, which is laterally aligned with a particular first cavity to which access is desired, in the direction indicated by the arrow in FIGS. 2 and 3, thereby inverting the second cavity as shown in FIG. 3. This action will disrupt the covering sheet 14 in the area at 16 along the line represented by 20 thus forming a pull tab 22 which can be grasped between the forefinger and thumb and peeled back towards first cavity 12 thereby disrupting the heat sealed areas at 24 between the first and second cavities 12 and 18 and exposing the contents of the first cavity.

The lines 20 and 26 represent weakened lines in the covering sheet defining the three side edges of the second cavities which are non-adjacent to the first cavities, the weakened lines being formed for example by perforation, scoring, slitting etc. in order to facilitate opening the blister package. Moreover disruption of the covering sheet along the weakened lines 20 and 26 on inversion of the second cavities 18 is facilitated by leaving unsealed the small areas 28 which are bounded by the lines 20 and 26 and the edges of the second cavities 18 non-adjacent the first cavities.

If desired the strip packages of the invention can be provided with perforations indicated at 30 which extend through both sheets 10 and 14 and which permit the separation of the strip into individual units.

Figure 4:
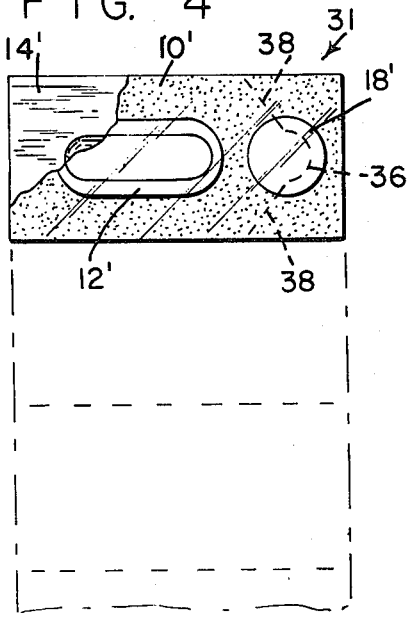
FIG. 4 is a view illustrating a modifiction of the embodiment shown in FIG. 1.

FIG. 4 shows a single unit of a modified blister strip generally indicated by the reference numeral 31. It will be understood however that the embodiment depicted in FIG. 4 can be formed into a multiple unit strip similar to that shown in FIG. 1. In the embodiment shown in FIG. 4, an underlying, cavity bearing sheet 10' is thermoformed to contain a first cavity 12' for containing a product and a second cavity 18' laterally aligned with each first cavity and spaced therefrom. An overlying covering sheet 14' covers the first and second cavities 12' and 18' and is heat sealed to the cavity bearing sheet in the areas surrounding the cavities as indicated by the shading.

Figure 5:
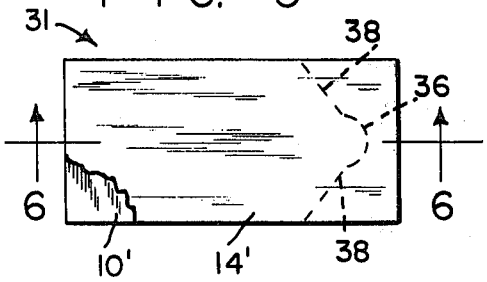
FIG. 5 is a view of a single unit of the modification of FIG. 4 as viewed from the bottom.

The covering sheet 14' is provided with weakened lines 36 and 38 shown in FIGS. 4 and 5. Weakened line 36 comprises a generally arcuate portion located within the area described by second cavity 18' and connected at its two ends with weakened lines 38 which comprise side portions extending at an oblique angle from opposite sides of the arcuate portion of the side edges of the unit and directed generally towards the first cavities.

Figure 6:
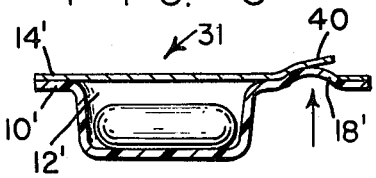
FIG. 6 is a section on line 6—6 of FIG. 5.

In the manipulation of the unit 31 to provide access to any given first cavity 12', a corresponding laterally aligned second cavity 18' is depressed as indicated by the arrow in FIG. 6 thus inverting the second cavity. This inversion disrupts the covering sheet 14' along the weakened arcuate line 36 thus forming a pull tab 40 which, as before, can be grasped and pulled back towards first cavity 12', the covering sheet being torn back along weakened side lines 38—38 which direct the peeling action towards the first cavity as the covering sheet is peeled off from the cavity bearing sheet 10'.

It will be appreciated from the foregoing that one not understanding the procedure required to effect rupture of the covering sheet permitting it to be peeled back to give access to the individual first cavities will not be able to open the package. Thus it will be seen that this invention also provides child resistant blister strip packages for medicaments.

We claim:

1. A blister strip package comprising a pair of heat sealable co-extensive sheets one of which is provided with a first cavity or row of spaced first cavities for containing a product to be dispensed, and a second cavity or row of second cavities each of which is laterally aligned with a corresponding first cavity and spaced therefrom, said sheets being heat sealed to one another except in the areas defined by the first and second cavities;

the other of said sheets overlying both said first and second cavities and covering the same;

said second cavities being adapted to being pushed inwards to an inverted state in order to disrupt the sheet covering said second cavities thereby providing a pull tab formed by the sheet covering said second cavities and enabling said sheet to be peeled back towards a respective first cavity to provide access thereto;

said second cavities having edges defining the area for peeling back the sheet covering the cavities.

2. The blister strip package of claim 1 wherein the cavity bearing and covering sheets are heat sealable plastic.

3. The blister strip package of claim 1 wherein the cavities in the cavity bearing sheet are thermoformed.

4. The blister strip package of claim 1 wherein the first cavities are larger than the second invertible cavities.

5. The blister strip package of claim 1 wherein the cavity bearing sheet is thicker than the covering sheet.

6. The blister strip package of claim 1 wherein the sheet covering the cavities is weakened along lines which diverge from the second cavity as the covering sheet is peeled towards the first cavity from the second cavity.

7. The blister strip package of claim 6 wherein the weakened line includes an arcuate portion within the area defined by the second cavity and which joins the diverging weakened lines.

8. The blister strip package of claim 7 wherein the arcuate and diverging lines are scored.

9. The blister strip package of claim 7 wherein the arcuate and diverging lines are perforated.

10. The blister strip package of claim 7 wherein the arcuate and diverging lines are slit.

11. The blister strip package of claim 1 wherein the sheet covering the cavities is weakened along lines spaced from and parallel to one another and defining the three side edges of the second cavities non-adjacent to the first cavities.

12. The blister strip package of claim 11 wherein the sheet covering the cavities is scored along lines defining the three side edges of the second cavities non-adjacent to the first cavities.

13. The blister strip package of claim 11 wherein the sheet covering the cavities is perforated along lines defining the three side edges of the second cavities nonadjacent to the first cavities.

14. The blister strip package of claim 11 wherein the sheet covering the cavities is slit along lines defining the three side edges of the second cavities non-adjacent to the first cavities.

15. The blister strip package of claim 6 wherein the weakened lines associated with each pair of first and second cavities comprise:

(a) a control arcuate portion within the the area defined by the second cavity, and (b) a pair of side portions extending from the central portion toward the first cavities at an oblique angle to the side edges of the unit and directed towards the first cavity.

16. The blister strip package of clam 15 wherein the strip is divided into individual units by perforations extending through both sheets which permit separation of individual pairs of first and second cavities.

17. A child resistant package comprising a pair of heat sealable co-extensive sheets one of which is provided with a first cavity or row of spaced first cavities for containing a product to be dispensed, and a second cavity or row of second cavities each of which is laterally aligned with a corresponding first cavity and spaced therefrom, said sheets being heat sealed to one another except in the areas defined by the first and second cavities;

the other of said sheets overlying both said first and second cavities and covering the same;

said second cavities being adapted to being pushed inwards to an inverted state in order to disrupt the sheet covering said second cavities thereby providing a pull tab formed by the sheet covering said second cavities and enabling said sheet to be peeled back towards a respective first cavity thereby providing access thereto.

* * * * *